United States Patent [19]

Yokoyama et al.

[11] Patent Number: 4,891,306

[45] Date of Patent: Jan. 2, 1990

[54] PHOTOGRAPHIC LIGHT-SENSITIVE SILVER HALIDE MATERIAL CONTAINING AN ANTISTATIC BLOCK COPOLYMER

[75] Inventors: Shigeki Yokoyama; Yukio Maekawa, both of Kanagawa, Japan

[73] Assignee: Fuji Photo Film Co., Ltd., Kanagawa, Japan

[21] Appl. No.: 270,461

[22] Filed: Nov. 14, 1988

Related U.S. Application Data

[63] Continuation-in-part of Ser. No. 144,635, Jan. 11, 1988, abandoned, which is a continuation of Ser. No. 915,838, Oct. 6, 1986, abandoned, which is a continuation of Ser. No. 719,407, Apr. 3, 1985, abandoned.

[30] Foreign Application Priority Data

Apr. 3, 1984 [JP] Japan ..... 59-66464

[51] Int. Cl.[4] ..... G03C 1/82

[52] U.S. Cl. ..... 430/527; 430/528; 430/529; 430/631; 430/634

[58] Field of Search ..... 430/527, 528, 631, 634, 430/529

[56] References Cited

U.S. PATENT DOCUMENTS

| | | | |
|---|---|---|---|
| 3,753,716 | 8/1973 | Ishihara et al. | 430/527 |
| 4,229,524 | 10/1980 | Yoneyama et al. | 430/527 |
| 4,266,915 | 5/1981 | Butler et al. | 430/527 |
| 4,362,812 | 12/1982 | Minamizono et al. | 430/528 |
| 4,495,275 | 1/1985 | Yokoyama et al. | 430/527 |

FOREIGN PATENT DOCUMENTS 2080559 2/1982 United Kingdom .

OTHER PUBLICATIONS

I. Skiest, "Copolymerization: The Composition Distribution Curve," J. Am. Chem. Soc'y., vol. 68, (1946), pp. 1781–1784.

V. E. Meyer et al, "Integral and Differential Binary Copolymerization Equations," J. Polym. Sci., vol. A3, (1965), pp. 2843–2851.

V. E. Meyer et al, "Computer Calculations of Batch--Type, Etc.," Polymer Preprints, vol. 8(1), (1967), pp. 209–215.

B. Vollmert, *Polymer Chemistry,* Ch. 4: "Synthesis of Macromolecules with C–C Chains", (1973), pp. 115–127.

A. Noshay et al, *Block Copolymers,* Ch. 3: "Block Copolymer Architecture", (1977), pp. 24–29.

*Primary Examiner*—Jack P. Brammer

*Attorney, Agent, or Firm*—Sughrue, Mion, Zinn, Macpeak & Seas

[57] ABSTRACT

A static-inhibited photographic light-sensitive material is provided by incorporating a fluorine-containing block polymer derived from a polymerizable hydrophobic monomer containing at least one fluorine atom and a polymerizable hydrophilic monomer, as an antistatic agent in at least one layer thereof. Unlike known antistatic agents and methods, the use of the above antistatic agent does not adversely affect the photographic characteristics, antitack property, marring resistance, etc., of the photographic light-sensitive material.

14 Claims, No Drawings

PHOTOGRAPHIC LIGHT-SENSITIVE SILVER HALIDE MATERIAL CONTAINING AN ANTISTATIC BLOCK COPOLYMER

This is a continuation of application Ser. No. 07/144,635 filed Jan. 11, 1988, now abandoned, which is a continuation of application Ser. No. 06/915,838, filed Oct. 6, 1986, now abandoned, which is a continuation of application Ser. No. 06/719,407, filed Apr. 3, 1985, now abandoned.

FIELD OF THE INVENTION

This invention relates to a photographic light-sensitive material and more particularly to a photographic light-sensitive material having an improved antistatic property.

BACKGROUND OF THE INVENTION

Photographic light-sensitive materials generally comprise an electrically insulating support coated with photographic layers, and it often happens during their production that static charges are built up as they are rubbed against each other or other surfaces. The static charges so accumulated can cause many problems, the most serious of which is that the static charge so built up discharges to sensitize the light-sensitive emulsion layer before development so that when the film is developed, there occur punctate defects or dentritic or feathery streaks. These are generally called static marks, and detract considerably from the market value of a photographic film, or, at worst, destroy the value completely. It is easy to understand that if static marks are formed on medical or industrial X-ray film, for instance, they may lead to a dangerous misdiagnosis or judgement. Since this blemish becomes apparent for the first time only upon development of the film, it presents a very serious problem. Moreover, the accumulated static charge may induce secondary problems, such as deposition of dust on the film surface and/or failures to obtain uniform coating results.

While the aforesaid static charge is often built up in the course of production, handling and use of a photographic light-sensitive material, such static charge build-up in the course of production takes place, for example, due to friction between the photographic film and the roller assembly or the exfoliation of the emulsion layer from the support during the take-up or rewinding of the film. It also develops due to contact or peeling stress between the X-ray film and the mechanical parts of fluorescent sensitizing paper in the automatic camera. Another cause is contact with packaging materials. The static marks on the photographic light-sensitive material as caused by such accumulation of static charge become more conspicuous as the sensitivity of the light-sensitive material and/or the photographic processing speed are increased. Particularly, recent years have witnessed an increasing opportunity of photographic light-sensitive materials being exposed to very tortuous conditions such as an increased sensitivity of the light-sensitive materials themselves, high speed coating processes, high speed photographing, high speed automatic processing, etc., and these factors have been contributing to an increasing incidence of static marks.

To overcome these problems due to static electricity, it is desirable to incorporate an antistatic agent in photographic light-sensitive materials. However, all the antistatic agents commonly used in other fields of art cannot be used as such in photographic light-sensitive materials, but antistatic agents that can be used must meet several requirements peculiar to this field of art. Thus, in addition to a high static inhibiting action, the antistatic agent useful for photographic light-sensitive materials must have the following and other characteristics. Thus, it should not exert untoward effects on the photographic characteristics of light-sensitive materials, such as sensitivity, fog, grain properties, sharpness, etc. Secondly, there should not be an adverse influence on the film strength of the photographic light-sensitive material (i.e., the light-sensitive material should be resistant to abrasion and scratching). Thirdly, the antitack property of the light-sensitive material should not be adversely affected (i.e., the light-sensitive materials should not be made liable to stick to each other or to other surfaces). Moreover, the antistatic agent should not accelerate the fatigue of the processing solutions used for the photographic light-sensitive material. In addition, the antistatic agent should not be one that may reduce the bond strength between constituent layers of the photographic light-sensitive material. Thus, the application of an antistatic agent to photographic light-sensitive materials is subject to these and other restrictions.

An approach toward eliminating these troubles due to static electricity is that of increasing the electrical conductivity of the surfaces of photographic light-sensitive materials, to thereby dissipate the accumulated static charge in a short time before a discharge of the static charge takes place. Accordingly, various methods have been proposed for improving the electrical conductivity of the support and various coating layers superimposed thereon of the photographic light-sensitive material. Thus, the use of various hygroscopic agents and water-soluble inorganic salts, certain types of surfactants, polymers, etc., has been recommended. For example, U.S. Pat. Nos. 2,882,157, 2,972,535, 3,062,785, 3,262,807, 3,514,291, 3,615,531, 3,753,716, 3,938,999, etc., mention such polymers; U.S. Pat. Nos. 2,982,651, 3,428,456, 3,457,076, 3,454,625, 3,552,972, 3,655,387, etc., refer to surfactants; and U.S. Pat. Nos. 3,062,700, 3,245,833, 3,525,621, etc., mention metal oxides, colloidal silica, etc.

However, many of these substances display properties specific only to some types of film supports and photographic compositions, and while these substances may produce satisfactory results with certain kinds of support films, photographic emulsions, and other photographic elements, they are quite useless or even exert adverse effects on photographic characteristics with other kinds of supports and photographic elements.

On the other hand, there also are many antistatic substances that cannot be used because they have adverse effects on photographic characteristics such as the sensitivity, fog, graininess, sharpness, etc., of the emulsion, notwithstanding the fact that they have excellent antistatic action. By way of illustration, polyethylene oxide compounds are generally known to have an antistatic effect, but tend to cause ill effects on photographic characteristics, such as increased fog, desensitization, graininess degradation, etc.

Particularly in regard to a direct X-ray-sensitive material for medical use, the support of which carries a radiographic emulsion layer on either side, it has been difficult to establish a technique for imparting an antistatic property thereto without sacrificing its photographic characteristics. Thus, it is very difficult to apply an antistatic agent to photographic light-sensitive materials, and the range of application has been limited.

Another approach toward obviating problems due to static charges in photographic light-sensitive materials is that of controlling the surface static potential of the light-sensitive material so as to minimize the generation of static electricity due to friction and contact. For example, attempts have been made to use fluorine-containing surfactants as described in British Pat. Nos. 1,330,356 and 1,524,621, U.S. Pat. Nos. 3,666,478 and 3,589,906, Japanese Patent Publication No. 26687/77, Japanese patent application (OPI) Ser. Nos. 46733/74 and 32322/76 (the term "OPI" as used herein refers to a "published unexamined Japanese patent application open to public inspection"), and so on in photographic light-sensitive materials for the above-mentioned purposes. However, since the static charge characteristics of photographic light-sensitive materials containing such fluorine-containing surfactants are dependent on the characteristics of the surfactant used, such as formation of a unimolecular film, they vary markedly with different processing conditions to which such photographic light-sensitive materials are subjected in the course of their production. The result is that uniform products having uniform static charge characteristics cannot be produced on a consistent basis. For example, the static charge characteristics of products vary widely in response to the temperature and humidity conditions used in the stages where the respective layers of the photographic light-sensitive materials are formed or the temperature, humidity, or/and drying time used in the drying stage subsequent to the coating processes. Therefore, while satisfactory products are obtained at times, products with quite poor static charge characteristics are produced at other times, thus presenting a serious obstacle to effective quality control. Thus, said fluorine-containing surfactants that have been used have the foregoing and other disadvantages.

To overcome the above-mentioned disadvantages of fluorine-containing surfactants, attempts have also been made to utilize fluorine-containing polymers in photographic light-sensitive materials. For example, U.S. Pat. No. 4,266,015 teaches the use of an emulsion (latex) of a homopolymer of a fluorine-containing alcohol acrylic or methacrylic acid ester or of a copolymer of such ester monomer with some other monomer and U.S. Pat. No. 4,299,524 discloses the use of a copolymer of said fluorine-containing monomer with a polyethylene oxide chain-containing monomer. Japanese Patent Publication No. 15376/82 teaches the use of a copolymer of a fluorine-containing monomer such as said fluorine-containing monomer, a fluorine-containing carboxylic acid vinyl ester, a fluorine-containing vinyl ether, or a fluorine-substituted olefin with a quaternary nitrogen-containing monomer, while U.S. Pat. No. 3,753,716 teaches the use of a terpolymer of a fluorine-containing alcohol maleic acid ester, maleic acid, and another monomer in the photographic light-sensitive material (particularly in its surface layer). When such a fluorine-containing polymer is applied to a photographic light-sensitive material, the surface static potential of the light-sensitive material can be modulated to a certain extent so that the generation of static charges due to friction or contact can be somewhat decreased. Moreover, this technique overcomes, in some measure, the above-mentioned disadvantages of fluorine-containing surfactants, namely, the disadvantage that the static charge characteristics of light-sensitive materials vary a great deal with production conditions and the disadvantage that said characteristics age or deteriorate with time. However, photographic light-sensitive materials incorporating such fluorine-containing polymers have various drawbacks, for example, in respect of said static charge characteristics or in regard to photographic characteristics and film physical properties which are important factors in photographic light-sensitive materials, and these drawbacks detract considerably from their market value so that virtually these polymers cannot be used in photographic light-sensitive materials.

The layer of a photographic light-sensitive material which contains the fluorine-containing polymer emulsion as described in U.S. Pat. No. 4,266,015 is so tacky that there tends to occur an adhesion between the emulsion layers or between the emulsion layer and the backing layer of the material, and once adhered to each other, they cannot be separated, or if they can be separated, a conspicuous adhesion scar remains. Moreover, the polymer-containing layer of the photographic light-sensitive material tends to be marred by frictional contact with other surfaces or by scratching and such mars detract from the market value of photographic light-sensitive materials in a remarkable degree. On the other hand, the fluorine-containing polymers described in U.S. Pat. No. 4,299,524, Japanese Patent Publication No. 15376/82, and U.S. Pat. No. 3,753,716 must be added in substantial amounts to photographic light-sensitive materials, for they are quite deficient in their ability to control the static potential. This means not only an increased production cost, but also produces adverse effects on photographic characteristics such as decreased sensitivity, reduced density, and fog as well as on film properties such as liability to stick, or to be marred. Therefore, these polymers cannot be utilized in photographic light-sensitive materials.

To obviate the above-mentioned disadvantages of fluorine-containing polymers, British Pat. No. 2,080,559 and U.S. Pat. No. 4,362,812 teach a fluorine-containing polymer obtainable by copolymerizing a hydrophobic fluorine-containing monomer, which is a styrene derivative, with a water-soluble monomer. This fluorine-containing polymer enables one to adjust the static charge potential with a reduced amount as compared with the first-mentioned fluorine-containing polymer so that the production cost can be reduced. Moreover, the above-mentioned adverse effects on photographic characteristics such as decreased sensitivity, reduced density, and fogging, and on film properties such as liability to stick or be easily marred can be alleviated.

However, the sensitivity of photographic light-sensitive materials has been on a steady increase in recent years, as epitomized by the development of color reversal film and color negative film with an ISO sensitivity of 1600.

The photographic characteristics of these high sensitivity photographic light-sensitive materials are very delicate and the addition of even a minor impurity may alter the photographic characteristics in a remarkable measure. Therefore, when an antistatic agent is to be added to such a high sensitivity photographic material, the antistatic agent must not only be inert to the photographic emulsion but must also be capable of producing a potent antistatic effect even when used in a small amount.

The above-mentioned fluorine-containing polymer realizes a sufficient antistatic effect without affecting the photographic characteristics as long as it is used in a low sensitivity photographic light-sensitive material, but it cannot be used with respect to the above-noted recent high sensitivity photographic materials. Thus, the untoward effects on photographic characteristics such as decreased sensitivity, reduced density, and fogging are inevitable and unavoidable with the polymer just mentioned insofar as it is applied to high sensitivity photographic materials.

Moreover, the development process has also become more rapid than ever before, and today photographic light-sensitive materials are developed under remarkably tortuous conditions.

As mentioned in regard to the recent trend toward an ever increasing sensitivity of photographic materials, photographic characteristics are becoming more and more delicate so that, in this regard too, the antistatic agent must not only be inert to the photographic emulsion but be capable of affording a sufficient antistatic effect while being used in as small an amount as possible. When a static-inhibited photographic light-sensitive material incorporating the above fluorine-containing polymer is subjected to rapid development, its photographic characteristics are adversely affected. Therefore, the above-mentioned fluorine-containing polymer cannot be utilized in conjunction with rapid development materials.

In addition, high speed coating technology has recently been applied to the production of photographic light-sensitive materials as well, and, mainly during take-up of the photographic light-sensitive material, the surface of the light-sensitive material is subjected to high pressure. Under the circumstances, it has become necessary that the surface of the photographic light-sensitive material will not stick, but rather will be low in tackiness.

In earlier low speed production processes, the surface of the photographic light-sensitive material was only subject to moderate pressure and, therefore, even the above-mentioned fluorine-containing polymer was sufficient to ensure the necessary antitack property. However, with the recent development of high speed coating technology, the surface of the photographic light-sensitive material has come to be subjected to very substantial pressure, so that the fluorine-containing polymer just mentioned is unable to ensure a sufficient antitack property.

In this connection, it is important to understand that the fluorine-containing polymers mentioned hereinbefore belong to the category of "random copolymers". Generally, a random copolymer is a copolymer in which two or more kinds of monomer units are randomly arranged. In the production of a random copolymer, the mixing of the constituent units takes place on a monomer scale so that a homogeneous polymer compound tends to be obtained. However, because of the interactions between the constituent monomers, for instance, it is in many cases impossible to obtain the characteristics typical of the respective homopolymers. On the other hand, a "blending" of dissimilar polymers does not give a uniform composition in many cases but the respective polymers form distinct phases so that the phenomenon called phase separation takes place. In contrast to the above polymers, the so-called block polymer in which a polymer chain consisting of monomer units of a given kind is connected to a polymer chain consisting of monomer units of another kind in a linear fashion is characterized in that because the two dissimilar polymer segments are joined together by chemical bonding, it does not undergo as serious a phase separation as does a polymer blend, but does undergo the so-called microphase separation, assuming a multiphase structure. This is an outstanding feature which is not found in random copolymers and polymer blends.

Various characteristics of block polymers are generally described, for example, in the *Society of High Polymer Chemistry: Polymer Alloys* (Tokyo Kagaku Dojin, 1981); R. J. Ceresa, *Block and Graft Polymerization*, Vol. 1 (John Wiley & Sons, 1973); and Yamashita et al., *Oil Chemistry*, Vol. 29, pp. 219–225 (1980).

Paying attention to these various characteristics of block polymers, the present inventors conducted an intensive research to develop an antistatic agent free of the above disadvantages of fluorine-containing random copolymers. As a result, it was found surprisingly that the use of a block polymer derived from a hydrophobic fluorine-containing monomer and a hydrophilic monomer as an antistatic agent in the photographic light-sensitive material results in complete elimination of all the aforesaid disadvantages of said fluorine-containing random copolymers.

SUMMARY OF THE INVENTION

A first object of this invention is to provide a static-inhibited photographic light-sensitive material which is substantially free from build-ups of static charge.

A second object of this invention is to provide a static-inhibited photographic light-sensitive material which is free from the adverse influence of increased sensitivity upon photographic characteristics such as density, fog, etc.

A third object of this invention is to provide a static-inhibited photographic light-sensitive material which is free from adverse effects on photographic characteristics even under extreme developing and processing conditions, such as rapid processing, etc.

A fourth object of this invention is to provide a static-inhibited photographic light-sensitive material which does not stick even if its surface is subjected to high pressure due to high speed production, etc.

These objects have now been accomplished by the present invention, which comprises incorporating a fluorine-containing block polymer, derived from a polymerizable hydrophobic fluorine-containing monomer having at least one fluorine atom and a polymerizable hydrophilic monomer, as an antistatic agent, in at least one layer of a photographic light-sensitive material.

Also, said fluorine-containing block polymer may contain a third polymerizable monomer unit.

DETAILED DESCRIPTION OF THE INVENTION

The preferred examples of the fluorine-containing block polymer according to this invention are as follows. The fluorine-containing block polymer according to this invention is preferably a fluorine-containing block polymer comprising one of repeating units represented by formulae (I), (II) and (III):

$$-\!\!\left(A\right)_{r}\!\left(B\right)_{s}\!\!- \qquad \text{(I)}$$

$$-\!\!\left(A\right)_{r}\!\left(B\right)_{u}\!\left(A\right)_{v}\!\!- \qquad \text{(II)}$$

$$-\!\!\left(B\right)_{w}\!\left(A\right)_{x}\!\left(B\right)_{y}\!\!- \qquad \text{(III)}$$

Referring to formulae (I), (II), and (III), A represents the monomer unit of a polymer obtainable by polymerizing a polymerizable fluorine-containing monomer having at least one fluorine atom; B represents the monomer unit of the polymer obtainable by polymerizing a polymerizable hydrophilic monomer; r, t, v, and x each represents the average degree of polymerization of monomer A and is a number between 2 and about 1,000; and s, u, w, and y each represents the average degree of polymerization of monomer B and is a number between 2 and about 5,000.

The block polymer of formula (I) is a block polymer consisting of two homopolymer segments, while the block polymer of formulae (II) and (III) each is a block polymer consisting of 3 homopolymer segments. A so-called multiblock polymer consisting of four or more homopolymer segments is also within the scope of this invention. Furthermore, these fluorine-containing block polymers may further contain a polymerizable third monomer.

The polymerizable hydrophobic fluorine-containing monomer having at least one fluorine atom as represented by A in formula (I), (II) or (III) is selected according to the contemplated mode of polymerization, but is preferably an addition-polymerizable monomer containing an ethylenically unsaturated group or a ring-opening polymerizable monomer.

The addition-polymerizable fluorine-containing monomer having an ethylenically unsaturated group is preferably a monomer of formula (IV) or a monomer of formula (V).

The monomer of formula (IV) is represented by

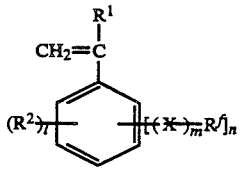

(IV)

wherein $R^1$ is a hydrogen atom, a chlorine atom, or an alkyl group containing from 1 to 3 carbon atoms; $R^2$ is a monovalent substituent group or two $R^2$'s can jointly form a ring; $R_f$ is an alkyl, aralkyl, aryl, or alkylaryl group containing from 1 to 30 carbon atoms and having one or more of its hydrogen atoms replaced by fluorine atoms; X is a divalent linking group represented by the formula $-(R)_{\bar{o}}L-$ or $-L-(R)_{\bar{o}}$, where R is an alkylene, arylene, or aralkylene group containing 1 to 10 carbon atoms, —L— is an —O—, —S—, $-NR^3-$ ($R^3$ is an alkyl group containing from 1 to 4 carbon atoms), —CO—, —OCO—, —SCO—, $-CONR^3-$, $-SO_2-$, $-NR^3SO_2-$, $-SO_2NR^3-$ or —SO— group, and $\bar{o}$ is 0 or 1; l is an integer of 0 to 4, and preferably an integer of 0 to 2, m is an integer of 0 to 4, and preferably an integer of 0 or 1; and n is an integer of 1 to 5, and preferably an integer of 1 or 2.

The monomer of formula (V) is represented by

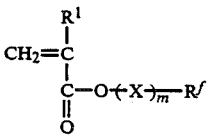

(V)

wherein $R^1$, X, $R_f$, and m are the same as defined for formula (IV).

Referring to formulae (IV) and (V), $R^1$ is more preferably a hydrogen atom or a methyl group; $R^2$ may, for example, be halogen, nitro, amino, alkylamino, carboxy, sulfo, carboxylic acid ester, sulfonic acid ester, carbamoyl, sulfamoyl, alkylsulfonyl, alkoxy, thioalkoxy, alkyl, or aryl. These and other examples are well-described in the literature, such as *The Chemical Society of Japan: Kagaku Binran (Chemical Handbook) Fundamentals II*, Revised 2nd Edition (Maruzen Co.), pp. 1012–1013; and Zeng Guangzhi, *Acta Chim. Sinica*, Vol. 32, p. 107 (1966). $R^2$ is preferably a halogen, nitro, alkyl, or the like. The $R^2$'s can jointly form a ring, which may, for example, be a benzene ring. $R_f$ represents an alkyl, aralkyl, aryl or alkylaryl group containing from 1 to 30 carbon atoms (preferably from 1 to 20), and has one or more of its hydrogen atoms replaced by fluorine atoms, preferred examples of which include perfluoromethyl, perfluoroethyl, perfluoropropyl, perfluorohexyl, perfluorooctyl, 2,2,3,3-tetrafluoropropyl, 2,2,3,3,4,4,5,5-octafluoroamyl, 2,2,3,3,4,4,5,5,6,6,7,7-dodecafluoroheptyl, 2,2,2-trifluoroethyl, 2,2,3,3,4,4,4-heptafluorobutyl, 1,1,1,3,3,3-hexafluoro-2-propyl, 1,1,1,3,3,3-hexafluoro-2-hydroxy-2-propyl, 1,1,2,2-tetrafluoro-2-hydroxyethyl, p-fluorophenyl, p-trifluoromethylphenyl, 2,3,4,5,6-pentatrifluoromethylphenyl, etc.

Exemplary monomers of formulae (IV) and (V) are as follows.

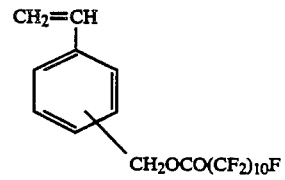

IV-1

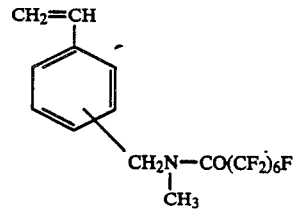

IV-2

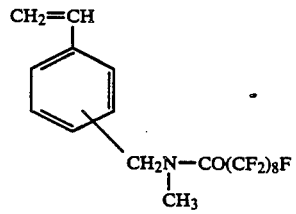

IV-3

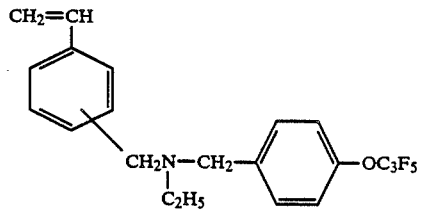

IV-4

-continued
IV-5
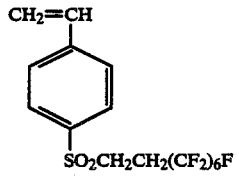
IV-6
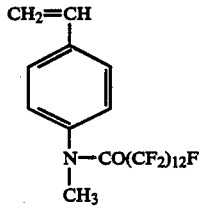
IV-7
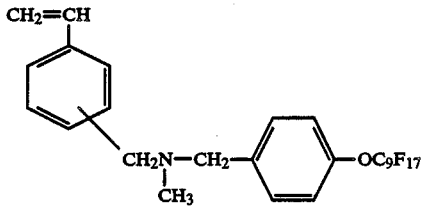
IV-8
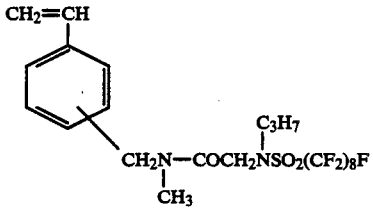
IV-9
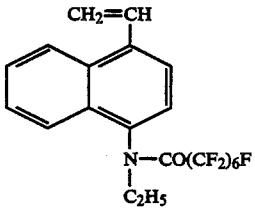
IV-10
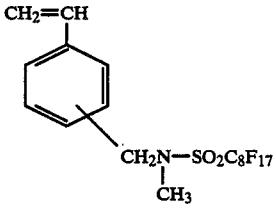
IV-11
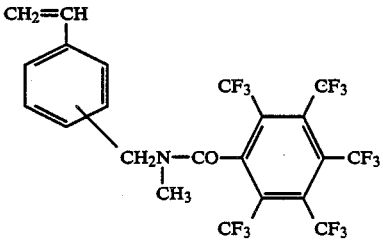
-continued
IV-12
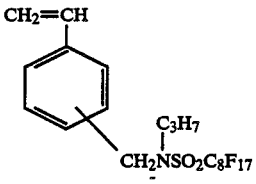
V-1
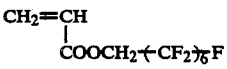
V-2
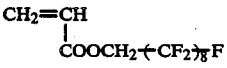
V-3
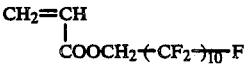
V-4
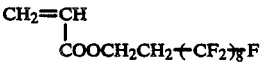
V-5
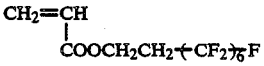
V-6
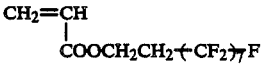
V-7
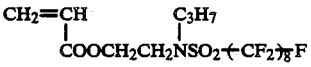
V-8
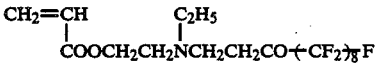
V-9
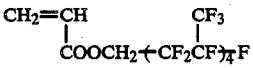
V-10
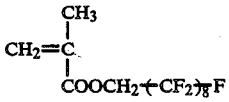
V-11
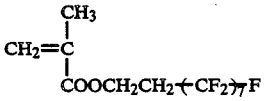
V-12
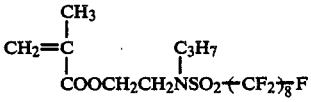
V-13
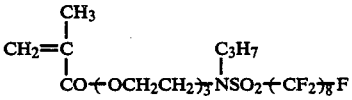
V-14
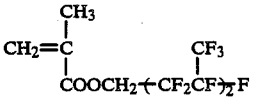
Referring to said polymerizable hydrophobic fluorine-containing monomer having at least one fluorine atom as represented by A in formula (I), (II), or (III), the monomers which undergo ring-opening polymerization are preferably 2-oxazoline monomers represented by formula (VI)

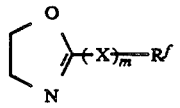

(VI)

wherein X, R*f* and m are the same as defined in formula (V).

The following is an exemplary list of monomers of formula (VI).

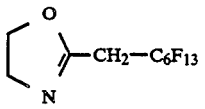

VI-1

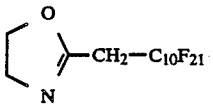

VI-2

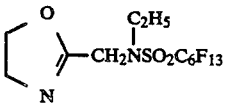

VI-3

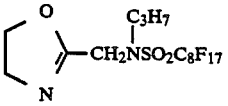

VI-4

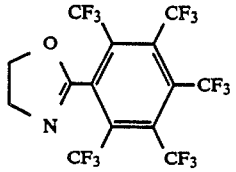

VI-5

Like the hydrophobic fluorine-containing monomer A, the polymerizable hydrophilic monomer represented by B in formula (I), (II), or (III) is also selected according to the intended mode of polymerization, and is preferably an addition-polymerizable monomer containing an ethylenically unsaturated group or a ring-opening polymerizable monomer.

Such addition-polymerizable hydrophilic monomer containing an ethylenically unsaturated group includes, but is not limited to, nonionic monomers such as acrolein, acrylamide, methacrylamide, N-methylolacrylamide, N,N-dimethylaminoethylacrylamide, N,N-dimethylaminopropylacrylamide, hydroxyethyl methacrylate, N,N-dimethylaminoethyl acrylate, N,N-dimethylaminoethyl methacrylate, poly(ethyloxy)acrylate, poly(ethyloxy)methacrylate, 2-vinylpyridine, 4-vinylpyridine, 1-vinyl-2-pyrrolidone, 1-vinylimidazole, 1-vinyl-2-methylimidazole, etc.; cationic monomers such as vinylbenzyltrimethylammonium, vinylbenzyltriethylammonium, vinylbenzyltripropylammonium, vinylbenzyldimethylamine hydrochloride, methacryloxyethyltrimethylammonium, methacryloxyethyldimethylethylammonium, N,N-dimethylaminoethyl methacrylate hydrochloride, etc., and anionic monomers such as acrylic acid, methacrylic acid, maleic acid, styrenesulfonic acid, 2-acrylamido-2-methylpropanesulfonic acid, etc., and salts thereof.

Examples of said ring-opening polymerizable monomer include substituted or unsubstituted cyclic ethers such as ethylene oxide, glycidol, propylene oxide, tetrahydrofuran, trioxane, etc.; 2-oxazoline and substituted-2-oxazolines such as those represented by the formula

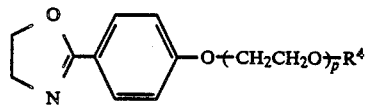

wherein p is a number of 1 to 50; $R^4$ is a hydrogen atom or an alkyl group containing 1 to 3 carbon atoms; and lactones such as β-propiolactone, etc.

For additional examples, see Saekusa, *Ring-Opening Polymerization* (I), (Kagaku Dojin, 1971).

The third monomer copolymerizable with the fluorine-containing block polymer according to this invention is exemplified by olefins such as ethylene, propylene, 1-butene, etc.; styrene and its derivatives such as α-methylstyrene, vinyltoluene, chloromethylstyrene, divinylbenzene, etc.; ethylenically unsaturated esters of organic acids such as vinyl acetate, acrylic acetate, etc.; ethylenically unsaturated carboxylic acid esters such as methyl acrylate, methyl methacrylate, n-butyl acrylate, n-butyl methacrylate, benzyl acrylate, benzyl methacrylate, cyclohexyl acrylate, cyclohexyl methacrylate, 2-ethylhexyl acrylate, etc.; ethylenically unsaturated carboxylic acid amides such as N-butylacrylamide, N-amylacrylamide, etc.; dienes such as butadiene, isoprene, etc.; acrylonitrile; vinyl chloride; maleic anhydride; etc. In addition, the ring-opening polymerizable monomers described in Saekusa, *Ring-Opening Polymerization* (I) and (II), (Kagaku Dojin, 1971) may also be used. It is to be understood that said third monomer is not limited to those mentioned above.

The fluorine-containing block polymer of this invention can be synthesized by various methods such as radical polymerization, anionic polymerization, cationic polymerization, coordination polymerization, sequential growth reaction, etc.; the preferred method of synthesis depends on the structures and reactivities of the starting material hydrophobic fluorine-containing monomer and hydrophilic monomer.

Methods of synthesis of block polymers are described in various literature, such as in *Polymer Alloy*, pp. 10–22 (Tokyo Kagaku Dojin, 1981); R. J. Ceresa, Ed., *Block and Graft Polymerization*, Vol. 1 (John Wiley & Sons, 1973), etc., and these methods can be applied to the synthesis of the fluorine-containing block polymer of this invention.

Examples of the fluorine-containing block polymer according to this invention are as follows.

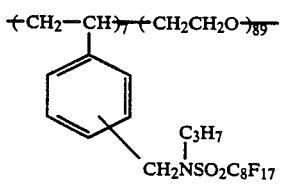

BP-1

-continued

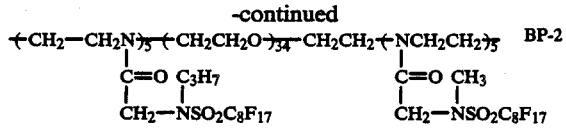

BP-2

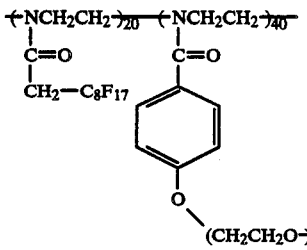

BP-3

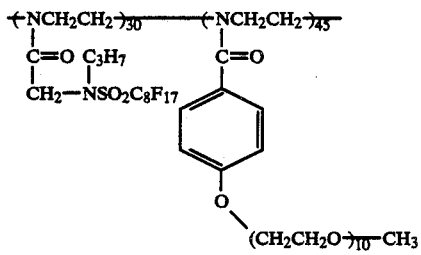

BP-4

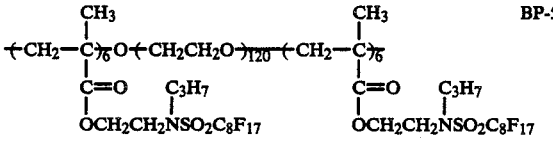

BP-5

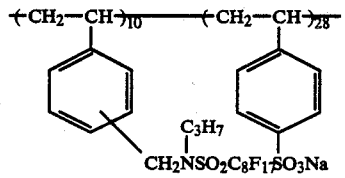

BP-6

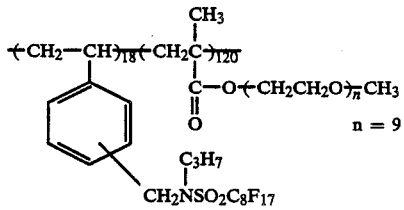

BP-7

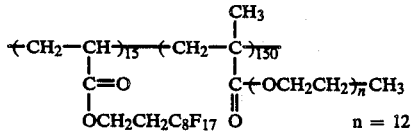

BP-8

Examples of synthesis of fluorine-containing block polymer according to this invention are as follows.

SYNTHESIS EXAMPLE 1

Synthesis of Fluorine-Containing Graft Polymer BP-1

A glass reaction vessel in which a high vacuum was established with an oil rotary pump and mercury diffusion pump was charged with 80 ml of a solution of the initiator cumylpotassium in tetrahydrofuran (0.183 mol/l; prepared in accordance with *Shin Jikken Kagaku Koza* (*Lectures on New Experimental Chemistry*), Vol. 19, published by The Chemical Society of Japan; *Polymer Chemistry* (I), pp. 64–65 (Maruzen, 1978). Then, at room temperature, 500 ml of a solution of fluorine-containing Monomer IV-12 in tetrahydrofuran (0.29 mol/l) was added and the anionic polymerization of fluorine-containing Monomer IV-12 was conducted. A small sample was taken from the resulting polymer of Monomer IV-12 and the number average degree of polymerization was measured by the vapor pressure depression method. The average degree of polymerization was 7.2.

To the same reaction vessel was added 88 g of cooled ethylene oxide and the polymerization reaction was conducted for 30 hours. The reaction product was purified by repeated precipitation and dried to give 71 g of fluorine-containing Block Polymer BP-1. Based on elemental analysis, the average degree of polymerization of the ethylene oxide was 89.

SYNTHESIS EXAMPLE 2

Synthesis of Fluorine-Containing Block Copolymer BP-2

A 500 ml three-necked flask fitted with a stirrer, calcium chloride desiccator and reflux condenser was charged with 100 g of polyethylene glycol (average degree of polymerization 35; available commercially from Nippon Oils and Fats Co., Ltd., under the trade name of PEG-1540). After the polyethylene glycol was dissolved in 200 ml of pyridine, 37 g of p-toluenesulfonyl chloride was added at room temperature. The reaction was conducted at 50° C. for 4 hours, whereby 60 g of polyethylene glycol di(p-toluenesulfonate) was obtained. Then, 12 g of this polymer, 40 g of fluorine-containing Monomer VI-4, and 200 ml of solvent tetrahydrofuran were placed in a tube and after purging with nitrogen gas, the tube was sealed. The tube was heated at 60° C. to conduct a cationic polymerization. The reaction product was purified by repeated precipitation, and dried to give 38 g of fluorine-containing Block Copolymer BP-2.

The application amount of the fluorine-containing block polymer of this invention varies according to types and forms of photographic light-sensitive material, coating method, etc. Generally, however, it is used in a proportion of from 0.001 to 0.1 g/m$^2$ of photographic light-sensitive material and preferably 0.001 to 0.02 g/m$^2$.

As regards the method of incorporating the block polymer of this invention in a layer or layers of the photographic light-sensitive material, one may employ the steps of dissolving it in an organic solvent (e.g., methanol, ethanol, acetone, methyl ethyl ketone, ethyl acetate, acetonitrile, dioxane, dimethylformamide, formamide, dimethyl sulfoxide, methyl cellosolve, ethyl cellosolve, etc.) or a mixture of such organic solvents and having the solution contained in the light-sensitive emulsion layer or a non-light-sensitive auxiliary layer (for example, a backing layer, antihalation layer, interlayer or protective layer) or applying it to the surface of the photographic light-sensitive material by spraying, coating or dipping, followed by drying.

It is also possible to use the block polymer of this invention in combination with a binder such as gelatin, polyvinyl alcohol, cellulose acetate, cellulose acetate phthalate, polyvinyl formal, polyvinyl butyral or the like to form an antistatic layer.

It is also possible to use other antistatic agents in the layer containing the fluorine-containing block polymer of this invention or in other layer or layers, whereby still more satisfactory antistatic effects may sometimes be obtained. Examples of such other antistatic agents include polymers as described in U.S. Pat. Nos. 2,882,157, 2,972,535, 3,062,785, 3,262,807, 3,514,291, 3,615,531, 3,753,716, 3,938,999, 4,070,189 and 4,147,550, German Pat. No. 2,800,466, and Japanese patent application (OPI) Ser. Nos. 91165/73, 94433/73, 46733/74, 54672/75, 94053/75, and 129520/77; surfactants as described in U.S. Pat. Nos. 2,982,651, 3,428,456, 3,457,076, 3,454,625, 3,552,971, and 3,655,387, for instance; the metal oxides described in U.S. Pat. Nos. 3,062,700, 3,245,833, and 3,525,621, for instance; and the so-called matting agent comprising colloidal silica or composed of strontium barium sulfate, polymethyl methacrylate, methyl methacrylate-methacrylic acid copolymer and colloidal silica or silica powder, for instance.

The layer containing the fluorine-containing block polymer of this invention may, for example, be the emulsion layer or the subbing layer, interlayer, surface protective layer or overcoat layer on the same side of the emulsion layer or the backing layer on the opposite side of the emulsion layer. Of these layers, an outermost layer, such as the surface protective layer, overcoat layer, or backing layer is preferred.

The support of the photographic light-sensitive material to which the fluorine-containing block polymer of this invention can be applied includes films of polyolefins such as polyethylene, etc., polystyrene, cellulose derivatives such as cellulose triacetate, etc., and polyesters such as polyethylene terephthalate, etc., and baryta paper, synthetic paper, paper, etc., both sides of which have been covered with such polymer films, as well as other support materials analogous thereto.

The support layer used in accordance with this invention may be provided with an antihalation layer. For this purpose, carbon black or various dyes such as oxonol dyes, azo dyes, arylidene dyes, styryl dyes, anthraquinone dyes, merocyanine dyes and tri(or di)arylmethane dyes, etc., can be utilized. As binders for carbon black and dyes, cellulose (di- or mono-)acetate, polyvinyl alcohol, polyvinyl butyral, polyvinyl acetal, polyvinyl formal, polymethacrylates, polyacrylates, polystyrene, styrene-maleic anhydride copolymer, polyvinyl acetate, vinyl acetate-maleic anhydride copolymer, methyl vinyl ether-maleic anhydride copolymer, polyvinylidene chloride, and their derivatives may be employed.

The photographic light-sensitive materials according to this invention may be made available in various forms, for example, ordinary black-and-white silver halide light-sensitive materials (e.g., black-and-white light-sensitive materials for photography, X-ray use, printing, etc.), ordinary multilayer color light-sensitive materials (e.g., color reversal film, color negative film, color positive film, etc.) and so on. The effects of this invention are realized particularly well in silver halide light-sensitive materials for high temperature rapid processing and high sensitivity silver halide light-sensitive materials. A photographic layer for a silver halide light-sensitive material according to this invention is described below.

As the binder for the photographic layer, proteins such as gelatin, casein, etc., cellulose compounds such as carboxymethyl cellulose, hydroxyethyl cellulose, etc., carbohydrates such as agar, sodium alginate, starch derivatives, etc., synthetic hydrophilic colloids such as polyvinyl alcohol, poly-N-vinyl-pyrrolidone, acrylic copolymers, polyacrylamide, and derivatives, partial hydrolysates, etc., thereof may be used in conjunction.

The term "gelatin" as used herein means any of lime-treated gelatin, acid-treated gelatin, and enzyme-treated gelatin.

The gelatin may be replaced, either in part or as a whole, with a synthetic high polymer or a gelatin derivative obtainable by modifying gelatin with a chemical reagent having a group reactive to the functional groups (such as amino, imino, hydroxy, or carboxyl) present in the molecule. It is also possible to use gelatin grafted to some other macromolecular chain.

There is substantially no limitation on the type and method of production of silver halide that may be used for the silver halide emulsion layer of the photographic light-sensitive material according to this invention, nor are there limitations on the method of chemical sensitization, antifogging agent, stabilizer, film hardener, antistatic agent, plasticizer, lubricant, coating assistant, matting agent, whitener, spectral sensitizing pigment, dye, color coupler, etc. Further detailed information regarding silver halide emulsions and components and additives therefor, references are described in literature such as *Product Licensing*, No. 92, pp. 107–110 (Dec., 1971) and *Research Disclosure*, No. 176, pp. 22–31 (Dec., 1978).

Regarding the antifogging agent and stabilizer, in particular, 4-hydroxy-6-methyl-1,3,3*a*,7-tetraazaindene-3-methylbenzothiazole, 1-phenyl-5-mercaptotetrazole and many other heterocyclic compounds, mercury-containing compounds, mercapto compounds, metal salts and numerous other compounds can be utilized. As examples of said film hardener, there may be mentioned aldehyde compounds such as mucochloric acid, muchbromic acid, mucophenoxychloric acid, mucophenoxybromic acid, formaldehyde, dimethylolurea, trimethylolmelamine, glyoxal, monomethylglyoxal, 2,3-dihydroxy-1,4-dioxane, 2,3-dihydroxy-5-methyl-1,4-dioxane, succinaldehyde, 2,5-dimethoxytetrahydrofuran, glutaraldehyde, etc.; active vinyl compounds such as divinylsulfone, methylenebismaleimide, 5-acetyl-1,3-diacryloyl-hexahydro-s-triazine, 1,3,5-triacryloylhexahydro-s-triazine, 1,3,5-trivinylsulfonyl-hexahydro-s-triazine bis(vinylsulfonylmethyl)ether, 1,3-bis(vinylsulfonylmethyl)propanol-2, bis(α-vinylsulfonylacetamido)ethane, etc.; active halogen compounds such as 2,4-dichloro-6-hydroxy-s-triazine sodium, 2,4-dichloro-6-methoxy-s-triazine, 2,4-dichloro-6-(4-sulfonailino)-s-triazine sodium, 2,4-dichloro-6-(2-sulfoethylamino)-s-triazine, N,N'-bis(2-chloroethylcarbamyl)piperazine, etc.; epoxy compounds such as bis(2,3-epoxypropyl)methylpropylammonium p-toluenesulfonate, 1,4-bis(2',3'-epoxypropoxy)butane, 1,3,5-triglycidylisocyanurate, 1,3-diglycidyl-5-(γ-acetoxy-β-oxypropyl)isocyanurate, etc.; ethyleneimine compounds such as 2,4,6-triethyleneimino-s-triazine, 1,6-hexamethylene-N,N'-bisethyleneurea, bis-β-ethyleneiminoethylthioether, etc.; methanesulfonic acid ester compounds such as 1,2-di(methanesulfonyloxy)ethane, 1,4-di(methanesulfonyloxy)butane, 1,5-di(methanesulfonyloxy)pentane; carbodiimide compounds, isoxazole compounds; and inorganic compounds such as chrome alum, etc.

In the photographic layer of this invention, there may be incorporated one or more of the hitherto known surfactants. The surfactants that can be used include natural surfactants such as saponin, etc.; nonionic surfactants such as alkylene oxides, glycerin, glycidol and other surfactants; cationic surfactants such as higher alkylamines, quaternary ammonium salts, pyridine and other heterocyclic compounds, phosphonium or sulfonium compounds, etc.; anionic surfactants containing acidic groups such as carboxylic acids, sulfonic acids, phosphoric acids, sulfuric acid esters, phosphoric acid esters, etc.; and amphoteric surfactants such as amino acids, aminosulfonic acids, sulfuric or phosphoric acid esters of aminoalcohols, and so on.

The photographic light-sensitive material according to this invention may contain the alkyl acrylate latices described in U.S. Pat. Nos. 3,411,911 and 3,411,912, Japanese Patent Publication No. 5331/70, etc.

The following examples are intended to illustrate this invention in further detail and should be no means construed as limiting the scope of the invention.

EXAMPLE 1

(1) Preparation of Samples

The emulsion layer dope and surface protective layer dope mentioned below were prepared and used to coat a subbed polyethylene terephthalate support film as thick as 180 μ in the order of the emulsion layer and protective layer by the concurrent extrusion coating method, followed by drying.

The other side of the support was also coated with the same dopes in the same manner as above to give a photographic light-sensitive material. The coating amount or coverage of silver on either side of the support was 4.0 g/cm$^2$. The gelatin coverage for the surface protective layer was 1.1 g/m$^2$.

The fluorine-containing block polymer of this invention or the control fluorine-containing polymer was added to the protective layer dope.

Preparation of the Silver Halide Emulsion

Silver iodide grains (silver iodide 1.5 mol %) (average particle size 1.35 μ) were prepared in the presence of ammonia by the double jet method and chemically sensitized with chloroaurate and sodium thiosulfate. After this chemical sensitization, an antifogging agent (1-phenyl-5-mercaptotetrazole), a stabilizer (4-hydroxy-6-methyl-1,3,3*a*,7-tetraazaindene) and coating assistants were added so as to give an emulsion dope. The specific gravity of the coating dope was 1.12 and the weight ratio of silver to gelatin was 1.55.

Preparation of the Surface Protective Layer Dope

A 10% aqueous gelatin solution was prepared using gelatin, sodium polystyrenesulfonate, dispersed polymethyl methacrylate (average particle size 3.0 μ), sodium t-octylphenoxyethoxyethoxyethanesulfonate and N,N'-ethylenebis(vinylsulfonylacetamide) for use as a coating dope for formation of a surface protective layer.

(2) Test Methods

Method of Measuring the Static Potential

The above sample was cut into a rectangular specimen measuring 30 cm by 40 cm and conditioned for moisture at 25° C. and 25% R.H. for 5 hours. The specimen was then passed through a revolving pair of white neoprene rubber rollers (roller diameter 12 cm, roller width 1 cm, pressure between rollers 6 kg/cm$^2$, linear velocity 320 m/min.) and, in a Faraday cage, the static potential was measured with an electrometer. Photographic Characteristic Test:

The above film was sandwiched between a couple of Fuji Photographic Film Hi-Standard Screens (calcium tungstate) and exposed to X-rays through an aluminum wedge for 1/20 second. Using a roller-transport automatic developing machine (Fuji RU, built by Fuji Photo Film Co., Ltd.) and the developer solution of the following composition, development was carried out at 35° C. for 25 seconds. The developed specimen was fixed at 34° C. for 25 seconds, rinsed at 33° C. for 25 seconds and dried at 45° C. Then, sensitometry was carried out.

| Formulation of the Developer Solution | |
|---|---|
| Potassium Hydroxide | 29.14 g |
| Glacial Acetic Acid | 10.96 g |
| Potassium Sulfite | 44.20 g |
| Sodium Bicarbonate | 7.50 g |
| Boric Acid | 1.00 g |
| Diethylene Glycol | 28.96 g |
| Ethylenediaminetetraacetate | 1.67 g |
| 5-Methylbenzotriazole | 0.06 g |
| 5-Nitroindazole | 0.25 g |
| Hydroquinone | 30.00 g |
| 1-Phenyl-3-pyrazolidone | 1.50 g |
| Glutaraldehyde | 4.93 g |
| Sodium Metabisulfite | 12.60 g |
| Potassium Bromide | 6.00 g |
| Water to make | 1 liter |
| pH adjusted to | 10.25 |

Antitack Test

The above sample was cut into square sheets each measuring 4 cm by 4 cm and conditioned for moisture at 25° C. and 70% R.H. for 2 days. Two of the sheets were superimposed and, under a 1,500 g load, allowed to stand at 50° C. and 70% R.H. for 1 day. The two sheets were then pulled apart and the area of the stuck portion was measured and evaluated according to the following scheme.

| | | |
|---|---|---|
| Rank A | Bonded area | 0–40% |
| B | Bonded area | 41–60% |
| C | Bonded area | 61–80% |
| D | Bonded area | 81–100% |

(3) Results

The results are shown in Table 1.

TABLE 1

| Sample No. | Antistatic Agent (coating on either side, mg/m$^2$) | Static Potential (volts) | Photographic Characteristics: Fog | Sensitivity (relative value) | Maximum Density | Antitack Property |
|---|---|---|---|---|---|---|
| 1 (Blank) | — | +410 | 0.15 | 100 | 2.8 | C |
| 2 (Invention) | Block Polymer BP-1 (0.5) | +190 | " | " | " | B |
| 3 (Invention) | Block Polymer BP-1 (1) | +90 | " | " | " | B |
| 4 (Invention) | Block Polymer BP-1 (1.5) | 0 | " | " | " | A |
| 5 (Invention) | Block Polymer BP-4 (0.5) | +220 | " | " | " | B |

TABLE 1-continued

| Sample No. | Antistatic Agent (coating on either side, mg/m²) | Static Potential (volts) | Photographic Characteristics: Fog | Sensitivity (relative value) | Maximum Density | Antitack Property |
|---|---|---|---|---|---|---|
| 6 (Invention) | Block Polymer BP-4 (1) | +80 | " | " | " | B |
| 7 (Invention) | Block Polymer BP-4 (2) | −20 | " | " | " | A |
| 8 (Invention) | Block Polymer BP-5 (1.5) | 0 | " | " | " | A |
| 9 (Invention) | Block Polymer BP-2 (2) | +10 | " | " | " | B |
| 10 (Invention) | Block Polymer BP-7 (3) | −10 | " | " | " | B |
| 11 (Control) | Control Polymer 1 (2) | +110 | 0.16 | 97 | 2.8 | C |
| 12 (Control) | Control Polymer 1 (4) | +80 | 0.17 | 95 | 2.6 | C |
| 13 (Control) | Control Polymer 1 (8) | −10 | 0.18 | 93 | 2.5 | B |
| 14 (Control) | Control Polymer 2 (4) | +130 | 0.17 | 98 | 2.8 | C |
| 15 (Control) | Control Polymer 2 (8) | +60 | 0.19 | 97 | " | C |
| 16 (Control) | Control Polymer 2 (12) | +10 | 0.20 | 95 | " | B |

CONTROL POLYMER 1

Polymer P-1 (random copolymer), British Pat. No. 2,080,559

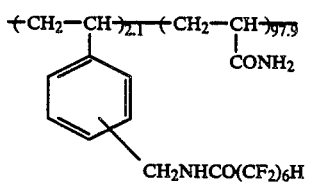

CONTROL POLYMER 2

Polymer P-1 (random copolymer), U.S. Pat. No. 4,362,812

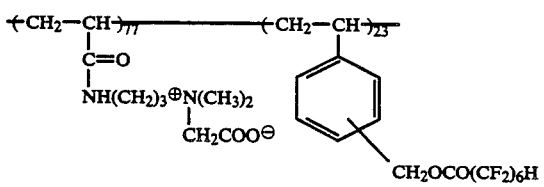

It is clear from the test results set forth in Table 1 that whereas the static charge on the blank sample free of an antistatic agent (Sample No. 1) was large, the samples containing appropriate amounts (1.5 to 3 mg/m²) of the block polymer of this invention (i.e., Sample No. 4: 1.5 mg/m², No. 7: 2 mg/m², No. 8: 1.5 mg/m², No. 9: 2 mg/m², No. 10: 3 mg/m²) were substantially not charged. On the other hand, the addition of Control Polymer 1 or 2 also resulted in a suppression of static charge, but it is clear that they had to be used in larger amounts for achieving the desired result (Sample No. 13: 8 mg/m², No. 16: 12 mg/m²). Moreover, whereas the addition of the block polymer of this invention did not cause any significant influence on photographic characteristics, the addition of the control polymers caused increases in fog, decreases in sensitivity and reductions in maximum density. Particularly, at high levels of addition sufficient to reduce the static charge to zero, the control polymers exerted pronounced adverse effects on photographic characteristics. In regard to antitack property, while the addition of the graft polymer according to this invention resulted in remarkable improvements as compared with the blank sample (Sample No. 1), the addition of control polymers resulted in an improving tendency, but the degree of improvement was extremely small.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising from 0.5 to 3 mg/m² of a fluorine-containing block polymer, derived from a polymerizable hydrophobic monomer containing at least one fluorine atom and a polymerizable hydrophilic monomer, as an antistatic agent in at least one layer thereof, wherein said fluorine-containing block polymer comprises repeating units selected from the following formulae (I), (II) or (III):

$$-(A_r B_s \qquad \text{(I)}$$

wherein A is a repeating unit of a polymer segment obtained by polymerizing a polymerizable hydrophobic monomer containing at least one fluorine atom; B is a repeating unit of a polymer segment obtained by polymerizing a polymerizable hydrophilic monomer; r is an average degree of polymerization between 5 and about 1,000; and s is an average degree of polymerization between 5 and about 5,000;

$$-(A_t B_u A_v \qquad \text{(II)}$$

wherein A and B are repeating units as claimed above; t and v each is an average degree of polymerization between 5 and about 1,000; and u is an average degree of polymerization between 5 and about 5,000; and $$-(B_w A_x B_y \qquad \text{(III)}$$

wherein A and B are repeating units as claimed above; w and y each is an average degree of polymerization between 5 and about 5,000 and x is an average degree of polymerization between 5 and about 1,000;

wherein said A is an addition-polymerizable monomer containing an ethylenically unsaturated group selected from the monomers represented by formulae IV and V:

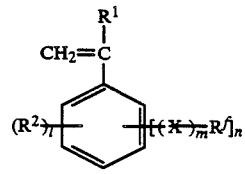
(IV)

wherein $R^1$ is a hydrogen atom, a chlorine atom, or an alkyl group containing from 1 to 3 carbon atoms; $R^2$ is a monovalent substituent group or two $R^2$ s can jointly form a ring; $R_f$ is an alkyl, aralkyl, aryl, or alkylaryl group containing from 1 to 30 carbon atoms and having one or more of its hydrogen atoms replaced with fluorine atoms; X is a divalent linking group represented by the formula $-R_eL-$ or $-L-R_e$, wherein R is an alkylene, arylene or aralkylene group containing from 1 to 10 carbon atoms, —L— is —O—, —S—, $-NR^3-$ ($R^3$ is an alkyl group containing from 1 to 4 carbon atoms), —CO—, —OCO—, —SCO—, $-CONR^3-$, $-SO_2-$, $-NR^3SO_2-$, $-SO_2NR^3-$, or —SO—, e is 0 or 1, l is an integer of 0 to 4, m is an integer of 0 to 4, and n is an integer of 1 to 5; and

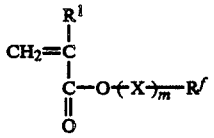

(V)

wherein $R^1$, $R_f$, X and m are defined the same as their definition above; or A is a ring-opening polymerizable monomer selected from the monomers represented by formula (VI)

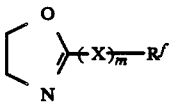

(VI)

wherein X, $R_f$ and m are defined the same as their definition above;

and wherein said repeating unit represented by B is an addition-polymerizable monomer containing an ethylenically unsaturated group selected from a nonionic monomer selected from acrolein, acrylamide, methyacrylamide, N-methylol-acrylamide, N,N-dimethylaminoethylacrylamide, N,N-dimethylaminopropylacrylamide, hydroxyethyl methacrylate, N,N-dimethylaminoethyl acrylate, N,N-dimethylaminoethyl methacrylate, poly(ethyloxy)-acrylate, poly(ethyloxy)-methacrylate, 2-vinylpyridine, 4-vinylpyridine, 1-vinyl-2-pyrrolidone, 1-vinylimidazole and 1-vinyl-2-methylimidazole; a cationic monomer selected from vinylbenzyltrimethylammonium, vinylbenzyl-triethylammonium, vinylbenzyltripropylammonium, vinylbenzyldimethylamine hydrochloride, methacryloxyethyltrimethylammonium, methacryloxyethyldimethylethylammonium and N,N-dimethylaminoethyl methacrylate hydrochloride; or an anionic monomer selected from acrylic acid, methacrylic acid, maleic acid, styrenesulfonic acid, 2-acrylamido-2-methylpropanesulfonic acid, and salts thereof; or said repeating unit represented by B is a ring-opening polymerizable monomer selected from a substituted or unsubstituted cyclic ether, 2-oxazoline, a substituted 2-oxazoline and a lactone.

2. A photographic light-sensitive material according to claim 1, wherein $R^1$ is a hydrogen atom, or a methyl group.

3. A photographic light-sensitive material according to claim 1, wherein $R^2$ is a halogen atom, a nitro group, or an alkyl group.

4. A silver halide photographic light-sensitive material according to claim 1, wherein said fluorine-containing block polymer is contained in an outermost layer of the photographic light-sensitive material.

5. A silver halide photographic light-sensitive material according to claim 1, wherein said fluorine-containing block polymer comprises repeating units represented by said formula (I).

6. A silver halide photographic light-sensitive material according to claim 1, wherein said fluorine-containing block polymer comprises repeating units represented by said formula (II).

7. A silver halide photographic light-sensitive material according to claim 1, wherein said fluorine-containing block polymer comprises repeating units represented by said formula (III).

8. A silver halide photographic light-sensitive material according to claim 1, wherein in said A represented by formulae (IV) and (V), $R_1$ is a hydrogen atom or a methyl group, $R_2$ is halogen, nitro, amino, alkylamino, carboxy, sulfo, carboxylic acid ester, sulfonic acid ester, carbamoyl, sulfamoyl, alkylsulfonyl, alkoxy, thioalkoxy, alkyl, or aryl, and $R_f$ contains from 1 to 20 carbon atoms.

9. A silver halide photographic light-sensitive material according to claim 1, wherein in said A represented by formulae (IV), (V) and (VI), said $R_f$ is selected from the group consisting of perfluoromethyl, perfluoroethyl, perfluoropropyl, perfluorohexyl, perfluorooctyl, 2,2,3,3-tetrafluoropropyl, 2,2,3,3,4,4,5,5-octafluoroamyl, 2,2,3,3,4,4,5,5,6,6,7,7-dodecafluoroheptyl, 2,2,2-trifluoroethyl, 2,2,3,3,4,4,4-heptafluorobutyl, 1,1,1,3,3,3-hexafluoro-2-propyl, 1,1,1,3,3,3-hexafluoro-2-hydroxy-2-propyl, 1,1,2,2-tetrafluoro-2-hydroxyethyl, p-fluorophenyl, p-trifluoromethylphenyl and 2,3,4,5,6-pentatrifluoromethylphenyl.

10. A silver halide photographic light-sensitive material according to claim 1, said fluorine-containing block polymer further comprising in addition to repeating units A and B a third type of monomer copolymerizable therewith, said third monomer being selected from the group consisting of olefins, styrene and its derivatives, ethylenically unsaturated esters of organic acids, ethylenically unsaturated carboxylic acid esters, ethylenically unsaturated carboxylic acid amides, dienes, acrylonitrile, vinyl chloride and maleic anhydride.

11. A silver halide photographic light-sensitive material according to claim 1, wherein said fluorine-containing block polymer is selected from the group consisting of:

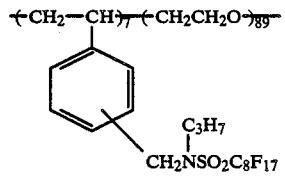

BP-1

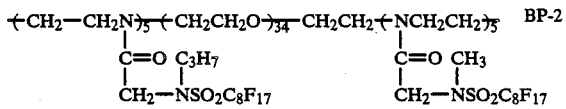

BP-2

-continued

BP-3

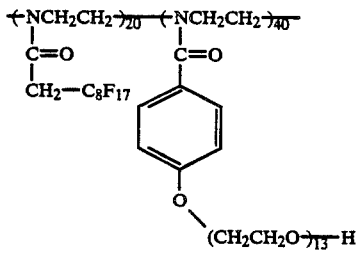

BP-4

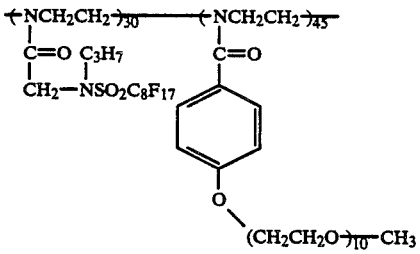

BP-5

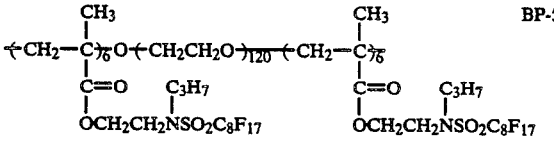

BP-6

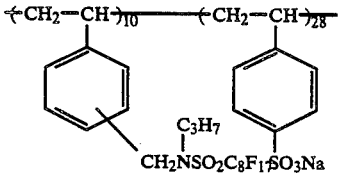

-continued

BP-7

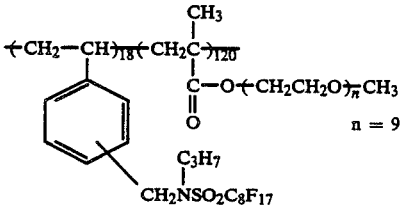

BP-8

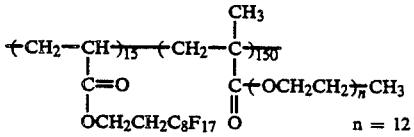

12. A silver halide photographic light-sensitive material according to claim 1, wherein said cyclic ether is selected from the group consisting of ethylene oxide, glycidol, propylene oxide, tetrahydrofuran and trioxane.

13. A silver halide photographic light-sensitive material according to claim 1, wherein said substituted-2-oxazoline is represented by the formula:

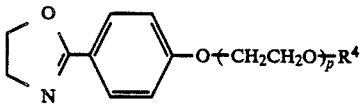

wherein p is a number of 1 to 50; $R^4$ is a hydrogen atom or an alkyl group containing 1 to 3 carbon atoms.

14. A silver halide photographic light-sensitive material according to claim 1, wherein said lactone is β-propiolactone.

* * * * *